United States Patent [19]

Hirano et al.

[11] Patent Number: 4,518,687

[45] Date of Patent: May 21, 1985

[54] SILVER HALIDE COLOR PHOTOGRAPHIC LIGHT-SENSITIVE MATERIAL

[75] Inventors: Tsumoru Hirano; Makoto Umemoto; Mitsunori Hirano, all of Kanagawa, Japan

[73] Assignee: Fuji Photo Film Co., Ltd., Japan

[21] Appl. No.: 539,857

[22] Filed: Oct. 7, 1983

[30] Foreign Application Priority Data

Oct. 7, 1982 [JP] Japan ..... 57-176748

[51] Int. Cl.[3] ..... G03C 7/26

[52] U.S. Cl. ..... 430/548; 430/381; 430/552; 430/553; 430/627

[58] Field of Search ..... 430/381, 548, 552, 553, 430/627

[56] References Cited

U.S. PATENT DOCUMENTS

| | | | |
|---|---|---|---|
| 3,767,412 | 10/1973 | Monbaliu et al. | 430/503 |
| 3,926,436 | 12/1975 | Monbaliu et al. | 430/548 |
| 4,080,211 | 3/1978 | Van Paesschen et al. | 430/935 |
| 4,340,664 | 7/1982 | Monbaliu et al. | 430/548 |

OTHER PUBLICATIONS

Research Disclosure, Item 21728, May 1982.

*Primary Examiner*—J. Travis Brown

*Attorney, Agent, or Firm*—Sughrue, Mion, Zinn, Macpeak, and Seas

[57] ABSTRACT

A silver halide color photographic light-sensitive material is disclosed. The material is comprised of a support base having thereon a silver halide emulsion layer containing a cyan dye-forming oleophilic polymer coupler. The polymer coupler is comprised of three repeating units including a repeating unit of a cyan coupler corresponding to general formula (I), an ethylene type unsaturated monomer repeating unit corresponding to general formula (II) which contains an acid component and an ethylene type unsaturated monomer repeating unit corresponding to general formula (III). The cyan dye-forming oleophilic polymer coupler is present in the form of a dispersed product, said polymer coupler having been dissolved in an organic solvent followed by emulsion dispersion of a gelatine aqueous solution in the presence of a surfactant. The general formulae and their substituents are described in the specification. By utilizing the particularly disclosed polymer coupler, the material forms a color image having excellent fastness which respect to heat and wet heat when the image is in the form of a color photograph after development. The novel cyan color image forming oleophilic polymer coupler also makes it possible to obtain remarkably excellent color forming property in the photographic image.

17 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing a latex of a novel cyan color image forming oleophilic polymer coupler capable of coupling with an oxidation product of an aromatic primary amine developing agent.

BACKGROUND OF THE INVENTION

It is well known that upon the color development of a silver halide photographic light-sensitive material, after exposure, an oxidized aromatic primary amine developing agent can be reacted with a dye forming coupler to obtain a color image.

It is also known that, for the color development of a silver halide color photogrpahic material, an oxidized aromatic primary amine color developing agent can be reacted with a coupler to form a dye such as an indophenol, an indoaniline, an indamine, an azomethine, a phenoxazine, a phenazine, and the like, thus forming a color image. In this procedure, the subtractive color process is ordinarily used for color reproduction, and silver halide emulsions which are selectively sensitive to blue, green and red light, and yellow, magenta and cyan color image formers, which are respectively the complementary colors of blue, green and red, are employed. For example, a coupler of the acylacetanilide or benzoylmethane type is used for forming a yellow color image; a coupler of the pyrazolone, pyrazolobenzimidazole, cyanoacetophenone or indazolone type is generally used for forming a magenta color image; and a phenolic coupler, such as a phenol and a naphthol, is generally used for forming a cyan color image.

Color couplers must satisfy various requirements. For example, it is necessary that they have a good spectral property and provide a dye image having excellent stability to light, temperature, and humidity for a long period of time upon color development.

It is also required in a multilayer color photographic light-sensitive material that each coupler is fixed in a layer separated from each other in order to reduce color mixing and improve color reproduction. Many methods for rendering a coupler diffusion-resistant are known. One method is to introduce a long chain aliphatic group into a coupler molecule in order to prevent diffusion. Couplers according to such a method require a step of addition to an aqueous gelatin solution by solubilizing in alkali, or a step of dispersing in an aqueous gelatin solution by dissolving in a high boiling organic solvent, since the couplers are immiscible with an aqueous gelatin solution. Such color couplers may cause crystal formation in a photographic emulsion. Furthermore, when using a high boiling organic solvent, a large amount of gelatin must be employed since the high boiling organic solvent makes an emulsion layer soft. Consequently, this increases the thickness of the material even though it is desirable to reduce the thickness of the emulsion layer.

Another method for rendering a coupler diffusion-resistant is to utilize a polymer coupler obtained by polymerization of a monomeric coupler in a latex form. An example of a method of adding a polymer coupler in a latex form to a hydrophilic colloid composition is a method in which a latex prepared by an emulsion polymerization method is directly added to a gelatino silver halide emulsion and a method in which an oleophilic polymer coupler obtained by polymerization of a monomeric coupler is dispersed in a latex form in an aqueous gelatin solution. Some examples of the former emulsion polymerization methods include an emulsion polymerization method in an aqueous gelatin phase as described in U.S. Pat. No. 3,370,952 and an emulsion polymerization method in water as described in U.S. Pat. No. 4,080,211. An example of the latter method in which an oleophilic polymer coupler is dispersed in a latex form is described in U.S. Pat. No. 3,451,820.

The method of adding a polymer coupler in a latex form to a hydrophilic colloid composition has many advantages in comparison with other methods. For example, the deterioration of strength of the film formed is small, because the hydrophobic substance is in a latex form. Also, since the latex can contain coupler monomers in a high concentration, it is easy to incorporate couplers in a high concentration into a photogrpahic emulsion. Further, the film can be thinned since the increase in viscosity is small and, thereby, sharpness can be improved. Furthermore, color mixing is prevented, since a polymer coupler is completely immobilized and the crystallization of couplers in the emulsion layer is small.

With respect to the addition of these polymer couplers in a latex form to a gelatino silver halide emulsion, there are described, for example, 4-equivalent magenta polymer coupler latexes and methods of preparation thereof in U.S. Pat. No. 4,080,211, British Pat. No. 1,247,688, and U.S. Pat. No. 3,451,820, copolymer latexes with a competing coupler in West German Patent No. 2,725,591, and U.S. Pat. No. 3,926,436 and cyan polymer coupler latexes in U.S. Pat. No. 3,767,412 and *Research Disclosure,* No. 21728 (1982).

However, these cyan polymer coupler in a latex form have the following problems to be dissolved as well as many excellent features as described above, and thus it has been desired to overcome these problems. In particular, improvement in fastness to heat is strongly desired.

1. In a color photograph after development, the fastness to heat and wet heat of the cyan color image is low.

2. As the reaction rate of coupling is poor, the sensitivity, gradation and color density of the dye image formed are low.

*Research Disclosure* 21728 (1982) shows that in a latex having a grain size of 0.1 μm or less which is obtained by emulsion polymerization, the fastness to heat and wet heat can be improved by copolymerizing a cyan color image-forming monomer coupler with acrylic acid or methacrylic acid, but the color forming property is insufficient and further improvement is desired.

SUMMARY OF THE INVENTION

Therefore, an object of the present invention is to provide a latex of a novel cyan color image-forming oleophilic polymer coupler which forms a color image having fastness to heat and wet heat in a color photograph after development.

Another object of this invention is to provide a latex of a novel cyan image-forming oleophilic polymer coupler which has an excellent color forming property.

Yet another object of this invention is to provide a process for forming a cyan color image by developing a silver halide emulsion in the presence of a latex of a novel cyan color image-forming oleophilic polymer coupler.

Still another object of this invention is to provide a silver halide color photographic light-sensitive material containing a latex of a novel cyan color image-forming oleophilic polymer coupler, a photographic processing method, or an image-forming method using the material.

As a result of various studies, the present inventors have found that the objects of this invention can be achieved by a silver halide color photographic light-sensitive material containing a dispersed product which is obtained by dissolving a cyan color image-forming oleophilic polymer coupler comprised of at least three repeating units of a cyan coupler repeating unit corresponding to the general formula (I), an ethylene type unsaturated monomer repeating unit corresponding to the general formula (II) which contains an acid component which is incapable of oxidative coupling with an aromatic primary amine developing agent, and an ethylene type unsaturated monomer repeating unit corresponding to the general formula (III) which is incapable of oxidative coupling with an aromatic primary amine developing agent, in an organic solvent, followed by emulsion dispersion in a gelatin aqueous solution in the presence of a surfactant;

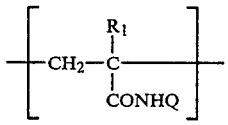

(I)

wherein $R_1$ represents a hydrogen atom, a lower alkyl group having 1 to 4 carbon atoms or a chlorine atom, and Q represents a cyan coupler residue capable of forming a dye upon coupling with an oxidized aromatic primary amine developing agent, more particularly, a cyan dye-forming phenol type or naphthol type coupler residue;

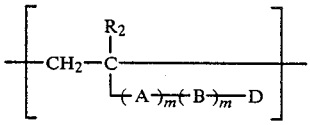

(II)

wherein $R_2$ represents a hydrogen atom, a lower alkyl group having 1 to 4 carbon atoms or a chlorine atom, A represents —COO— or —CONH—, B represents an alkylene, aralkylene or phenylene groups having 1 to 10 carbon atoms, and the alkylene group may be straight chain, branched chain or cyclic, D represents —COOM or $—SO_3M$, M represents a hydrogen atom or an alkali metal, and m represents 0 or 1.

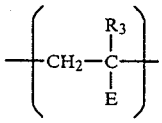

(III)

wherein $R_3$ represents a hydrogen atom, a lower alkyl group having 1 to 4 carbon atoms or a chlorine atom, E represents $—COOR_4$, $—NHCOR_4$, $—OCOR_4$ or a substituted or unsubstituted phenyl group, and $R_4$ represents an alkyl (straight chain, branched chain, cyclic) group having 1 to 10 carbon atoms or a phenyl group, in proviso that when $R_3$ is a hydrogen atom, E is not $—COOCH_3$.

DETAILED DESCRIPTION OF THE INVENTION

In this invention, the polymerization is initiated after dissolving a monomer in an organic solvent. Therefore it is believed that a difference from a conventional polymer coupler by emulsion polymerization in which the polymerization is conducted in a micell of a surfactant and in a latex grain is caused in the composition distribution of polymers, particularly, in the composition distribution of the acid component. It is further believed that the difference between the latex grain obtained by dissolving an oleophilic polymer coupler of this invention in an organic solvent followed by emulsion dispersion in a gelatin aqueous solution in the presence of a surfactant and the latex grain obtained by emulsion polymerization is also caused in existence conditions of the coupler part and the acid component in the latex grain. For example, in the process of this invention, the polymer chain of the polymer coupler once loses entanglement completely in the organic solvent which is used for dispersion. Then, when the solvent is removed and couplers are crystallized, the entanglement is newly caused in the polymer chain. On the other hand, when couplers are polymerized in the dispersing conditions, such action is not caused and accordingly these differences are presumed to result a difference in color forming property and fading property.

More particularly, in the cyan color image-forming polymer coupler latex of this invention, as the cyan coupler residue Q capable of forming a cyan color image upon coupling with the oxidized aromatic primary amine developing agent, phenol type (IV) or (V), or naphthol type (VI) is preferred.

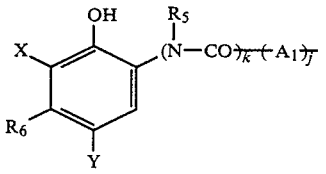

(IV)

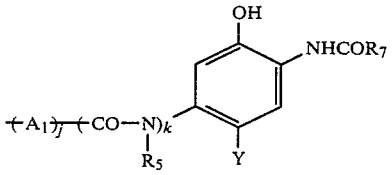

(V)

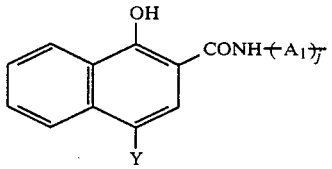

(VI)

wherein $R_5$ represents a hydrogen atom or a lower alkyl group having 1 to 4 carbon atoms, $A_1$ represents an unsubstituted or substituted alkylene, aralkylene or phenylene groups having 1 to 10 carbon atoms which are bonded to the NH group of the general formula (I), and the alkylene group may be either straight chain or branched chain.

Examples of the alkylene group for $A_1$ include methylene, methylmethylene, dimethylmethylene, dimethylene, trimethylene, tetramethylene, pentamethylene, hexamethylene and decylmethylene; examples of the aralkylene group for $A_1$ include benzylidene; and examples of the phenylene group for $A_1$ include p-phenylene, m-phenylene, methylphenylene and the like.

$R_6$ represents a hydrogen atom or a lower alkyl group having 1 to 5 carbon atoms (e.g., methyl, ethyl or t-butyl groups, etc.) and $R_7$ represents an unsubstituted or substituted alkyl (having 1 to 22 carbon atoms, preferably 1 to 6 carbon atoms), phenyl or phenylamino groups. X represents a halogen atom (e.g., fluorine, chlorine or bromine atoms), Y represents a hydrogen atom, a halogen atom (e.g., fluorine, chlorine or bromine atoms) or a substituted alkoxy group (having 1 to 22 carbon atoms, preferably 1 to 12 carbon atoms), and k and j each independently represents 0 or 1.

Examples of a substituent of the substituted alkylene, aralkylene, or phenylene groups represented by $A_1$ include an aryl group (e.g., phenyl group), a nitro group, a hydroxyl group, a cyano group, a sulfo group, an alkoxy group (e.g., methoxy group), an aryloxy group (e.g., phenoxy group), an acyloxy group (e.g., acetoxy group), an acylamino group (e.g., acetylamino group), a sulfonamido group (e.g., methanesulfonamide group), a sulfamoyl group (e.g., methylsulfamoyl group), a halogen atom (e.g., fluorine, chlorine, bromine, etc.), a carboxyl group, a carbamoyl group (e.g., methylcarbamoyl group), an alkoxycarbonyl group (e.g., methoxycarbonyl group, etc.) and a sulfonyl group (e.g., methylsulfonyl group). When there are two or more substituents they may be the same or different.

Examples of a substituent of the substituted alkoxy group represented by Y include an aryl group (e.g., phenyl group), a nitro group, a hydroxyl group, a cyano group, a sulfo group, an alkoxy group (e.g., methoxy group, etc.), an aryloxy group (e.g., phenoxy group, etc.), an acyloxy group (e.g., acetoxy group, etc.), an acylamino group (e.g., acetylamino group, etc.), an alkylsulfonamido group (e.g., methanesulfonamide group, etc.), an alkylsulfamoyl group (e.g., methylsulfamoyl group, etc.), a halogen atom (e.g., fluorine, chlorine, bromine, etc.), a carboxyl group, an alkylcarbamoyl group (e.g., methylcarbamoyl group), an alkoxycarbonyl group (e.g., methoxycarbonyl group, etc.), an alkylsulfonyl group (e.g., methylsulfonyl group, etc.) and an alkylthio group (e.g., $\beta$-carboxyethylthio group, etc.). When there are two or more substituents they may be the same or different.

Moreover, as a substituent of the substituted alkyl or phenyl groups represented by $R_7$, a fluorine atom is preferably used and examples of a substituent of the substituted phenylamino group represented by $R_7$ include a nitro group, a cyano group, a sulfonamido group (e.g., methanesulfonamide group), a sulfamoyl group (e.g., methylsulfamoyl group), a halogen atom (e.g., fluorine, chlorine, bromine), a carbamoyl group (e.g., methylcarbamoyl group) and a sulfonyl group (e.g., methylsulfonyl group). When there are two or more substituents they may be the same or different.

Examples of ethylene type unsaturated monomers corresponding to the general formula (II) containing the acid component which is incapable of oxidative coupling with an aromatic primary amine developing agent include acrylic acid, $\alpha$-chloroacrylic acid, $\alpha$-alkacrylic acid (e.g., methacrylic acid) and the ester of amide derived therefrom which contain the acid component, B of the above general formula (II) represents an alkylene group, an aralkylene group or a phenylene group, and the alkylene group may be straight chain, branched chain or cyclic. Examples of the alkylene group include methylene, methylmethylene, ethylene, methylethylene, dimethylethylene, trimethylene, tetramethylene, pentamethylene, hexamethylene and decylmethylene; examples of the aralkylene group include benzylidene; and examples of the phenylene group include p-phenylene, m-phenylene and the like.

Examples of the ethylene type unsaturated monomer corresponding to the general formula (III) which is incapable of coupling with the oxidation product of an aromatic primary amine developing agent include esters or amides derived from acrylic acid, $\alpha$-chloroacrylic acid, $\alpha$-alkacrylic acid (e.g., methacrylic acid, etc.) and the like (e.g., ethyl acrylate, n-propyl acrylate, n-butyl acrylate, t-butyl acrylate, iso-butyl acrylate, 2-ethylhexyl acrylate, cyclohexyl acrylate, methyl methacrylate, ethyl methacrylate, n-butyl methacrylate, n-butylacrylamide, t-butylacrylamide, diacetoneacrylamide and n-butylmethacrylamide), vinyl esters (e.g., vinylacetate and vinyl propionate), styrene and the like. In particular, acrylates and methacrylates are preferably used.

The non-color forming ethylene type unsaturated monomer used here may be used together with two kinds or more. For example, the combinations of ethyl acrylate and n-butyl acrylate, n-butyl acrylate and styrene, and methyl methacrylate and diacetoneacrylamide may be used.

The polymer coupler of this invention may contain two or more kinds of repeating units corresponding to the general formula (III).

The ethylene type unsaturated monomer which is used to copolymerize with the monomer coupler represented by the above-described general formula (I) can be selected so that the copolymer to be formed possesses good physical properties and/or chemical properties, for example, solubility, compatibility with a binder such as gelatin in a photographic colloid composition, flexibility, heat stability, etc., as well known in the field of polymer color couplers.

The cyan polymer coupler used in this invention is oleophilic and, in particular, preferably used in a latex form.

For the process of emulsion dispersion of an oleophilic polymer coupler in a latex form in a gelatin aqueous solution, the process described in U.S. Pat. No. 3,451,820 can be employed.

General polymerization processes of an oleophilic cyan polymer coupler are described below.

The free radical polymerization of the ethylene type unsaturated monomer is initiated with the addition to the monomer molecule of a free radical which is formed by thermal decomposition of a chemical polymerization initiator or a physical action, e.g., irradiation of ultraviolet rays or other high energy radiations, high frequencies, etc.

Examples of the main chemical polymerization initiators include azobis type polymerization initiators (e.g., dimethyl 2,2'-azobisisobutyrate, diethyl 2,2'-azobisisobutyrate, 2,2'-azobisisobutyronitrile, 2,2'-azobis-(2,4-dimethylvalenonitrile), etc.), benzoyl peroxide, chlorobenzoyl peroxide and other compounds.

Organic solvents which can be used in polymerization of the oleophilic cyan polymer couplers are preferably those which can usually be admixed with monomers to be used without limitation, are good solvent for the oleophilic polymer coupler formed, do not react with initiators to be used and do not interrupt usual actions in free radical addition polymerization.

Specific useful examples of the organic solvent include aromatic hydrocarbons (e.g., benzene, toluene, etc.), hydrocarbons (e.g., n-hexane, etc.), alcohols (e.g., methanol, ethanol, n-propanol, isopropanol, tert-butanol, etc.), ketones (e.g., acetone, methyl ethyl ketone, etc.), cyclic ethers (e.g., tetrahydrofuran, dioxane, etc.), esters (e.g., ethyl acetate, etc.), chlorinated hydrocarbons (e.g., methylene chloride, chloroform, etc.), amides (e.g., dimethylformamide, dimethylacetamide, etc.), sulfoxides (e.g., dimethylsulfoxide, etc.), nitriles (e.g., acetonitrile, etc.) and combinations thereof.

When the oleophilic polymer coupler is dispersed in a latex form in a gelatin aqueous solution, the organic solvent used for dissolving the oleophilic polymer coupler is removed from the mixture before coating the dispersed solution or at vaporization during drying of the coated dispersed solution, although the latter is rather unpreferable.

With respect to removing the solvent, a method in which the solvent is removed by washing a gelatin noodle with water is applied when the solvent is water-soluble to some extent, or a spray drying method, a vacuum purging method or a steam purging method can be employed for removing the solvent.

Examples of removable organic solvents include esters (such as lower alkyl esters), lower alkyl ethers, ketones, halogenated hydrocarbons (e.g., methylene chloride, trichloroethylene or hydrocarbon fluoride), alcohols (e.g., alcohols between n-butyl alcohol and octyl alcohol), and combinations thereof.

As the dispersing agent to disperse the oleophilic polymer coupler, any type agents may be used, but an ionic surfactant, in particular, anionic type surfactant, is suitable. The amphoteric type surfactant such as C-cetyl betaine, N-alkylaminopropionates and N-alkyliminodipropionates may be also used.

In order to control the color hue of dyes formed from the oleophilic polymer coupler and the oxidation product of an aromatic primary amine developing agent and to improve the bending property of the coated emulsion, a permanent solvent, i.e., a water non-miscible organic solvent having a high boiling point (200° C. or more), may be added.

Also, in order to make the final emulsion layer as thin as possible and to maintain a high sharpness, the concentration of the permanent solvent is preferably low.

It is desirable that the ratio of the color forming portion corresponding to the general formula (I) in the oleophilic polymer coupler is usually from 5 to 80% by weight. Particularly, a ratio from 20 to 70% by weight is preferred in view of color reproducibility, color forming property and stability. Also, it is desirable that the ratio of the non-color forming portion corresponding to the general formula (II) in the oleophilic polymer coupler is usually from 1 to 30% by weight. Particularly, a ratio from 5 to 20% by weight is preferred in view of color reproducibility, color forming property and fastness. Further, it is desirable that the ratio of the non-color forming portion corresponding to the general formula (III) in the oleophilic polymer coupler is usually from 1 to 80% by weight, preferably from 1 to 60% by weight. In this case, an equivalent molecular weight, that is, a gram number of the polymer containing 1 mol of a monomer coupler, is preferably from about 250 to 4,000, but it is not limited thereto.

The oleophilic polymer coupler of the present invention is used in an amount from $2\times10^{-3}$ to $5\times10^{-1}$ mol (calculated as the monomer coupler corresponding to the general formula (I)) per mol of silver, preferably from $1\times10^{-2}$ to $5\times10^{-1}$ mol per mol of silver.

Examples of a monomer coupler suitable for forming a latex of the oleophilic polymer coupler by polymerization according to this invention are shown in various literatures, for example, in U.S. Pat. Nos. 2,976,294; 3,767,412; 4,080,211; 4,128,427, and *Research Disclosure* 21728 (1982).

The typical examples are as follows, but this invention is not limited by them.

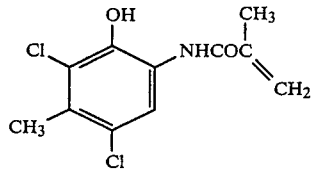
(1)

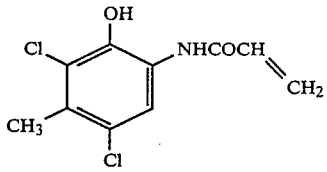
(2)

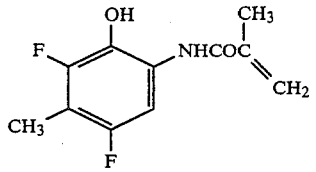
(3)

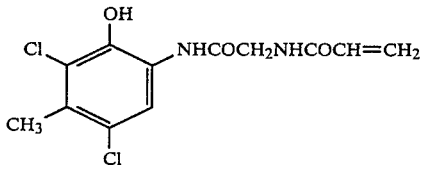
(4)

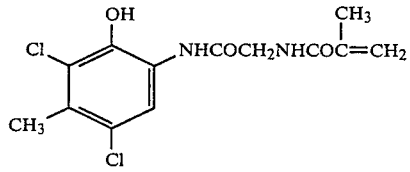
(5)

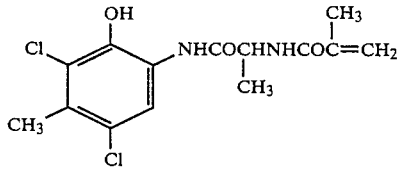
(6)

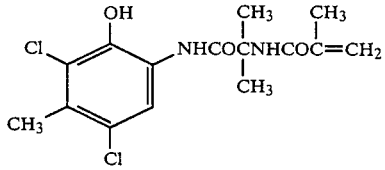
(7)

-continued
(8)
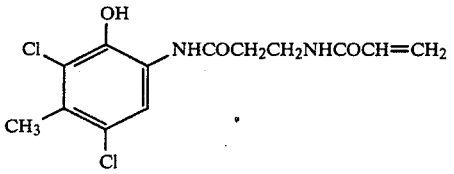
(9)
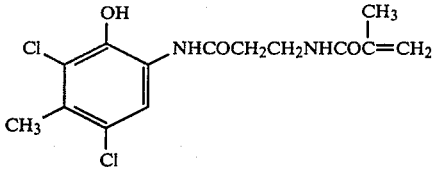
(10)
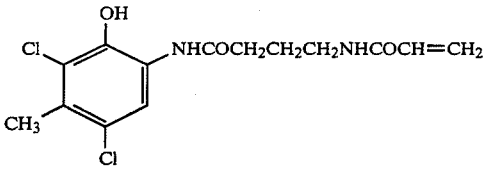
(11)
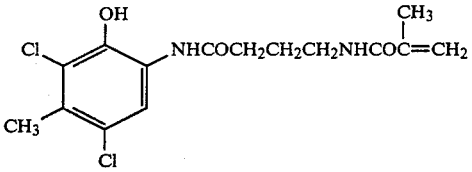
(12)
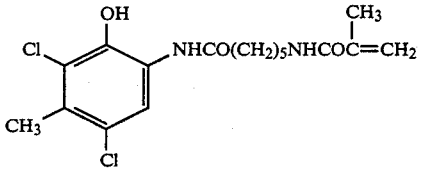
(13)
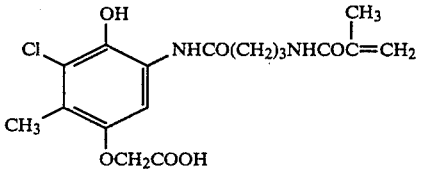
(14)
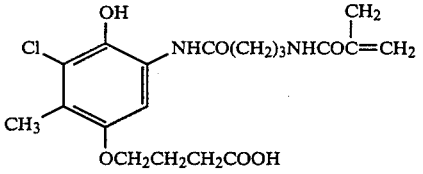
(15)
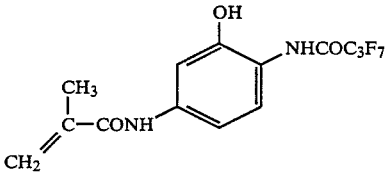
(16)
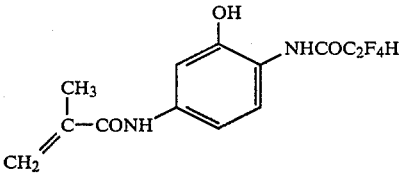
-continued
(17)
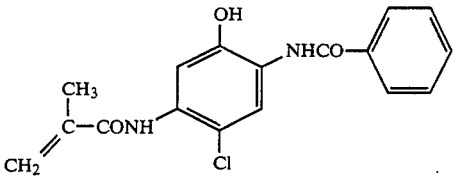
(18)
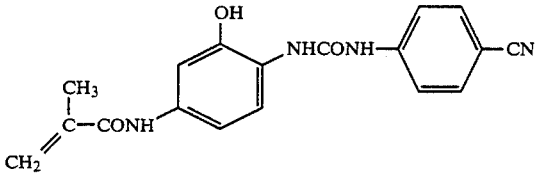
(19)
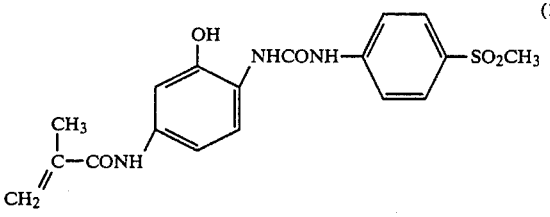
(20)
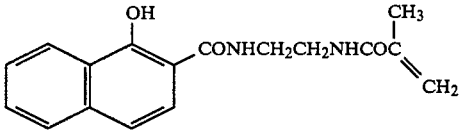
(21)
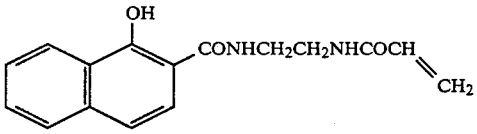
(22)
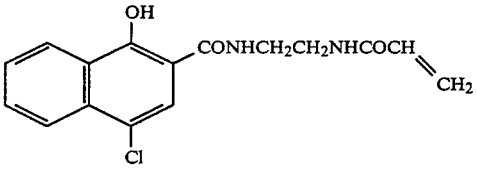
(23)
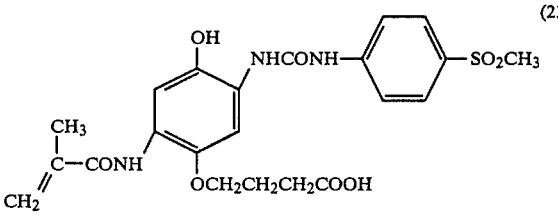
(24)
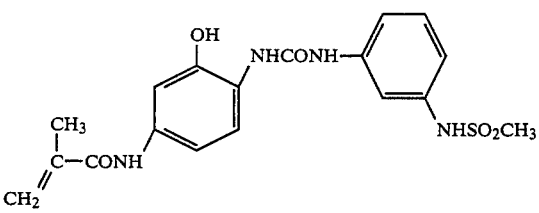

-continued

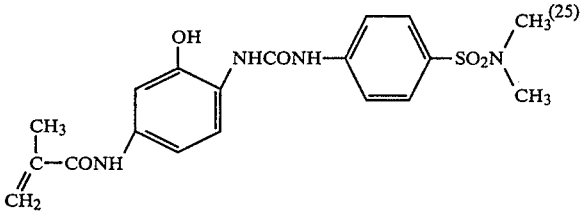

Examples of ethylene type unsaturated monomers containing the acid component represented by the general formula (II) which are suitable for forming a latex of the oleophilic cyan polymer coupler by polymerization according to this invention are as follows, but this invention is not limited by them.

$$CH_2{=}CH{-}COOH \quad \text{(i)}$$

$$CH_2{=}C(CH_3){-}COOH \quad \text{(ii)}$$

$$CH_2{=}CH{-}CONHCH_2COOH \quad \text{(iii)}$$

$$CH_2{=}C(CH_3){-}CONHCH_2COOH \quad \text{(iv)}$$

$$CH_2{=}C(CH_3){-}CONHCH(CH_3)COOH \quad \text{(v)}$$

$$CH_2{=}C(CH_3){-}CONHCH_2CH_2COOH \quad \text{(vi)}$$

$$CH_2{=}C(CH_3){-}CONH{-}(CH_2)_5{-}COOH \quad \text{(vii)}$$

$$CH_2{-}C(CH_3){-}CONH{-}(CH_2)_5{-}COOH \quad \text{(viii)}$$

$$CH_2{=}CHCONH{-}CH(CH_3){-}CH_2{-}SO_3H \quad \text{(ix)}$$

The typical synthetic examples of this invention are indicated below.

PREPARATION EXAMPLE (1)

Synthesis of copolymer coupler of 6-methacrylamide-2,4-dichloro-3-methylphenol [Monomer coupler (1)], methyl methacrylate and acrylic acid [Oleophilic Polymer Coupler (I)]:

A mixture of Monomer Coupler (1) 20 g, methyl methacrylate 17 g, methacrylic acid 3 g and dioxane 200 ml was heated to 80° C. under stirring while introducing nitrogen gas, then dioxane 10 ml containing dimethyl azobisisobutyrate 600 mg was added thereto to initiate polymerization. After reacting for 5 hours, the reaction mixture was cooled and poured into water 1 l, and the crystallized solid was filtered and sufficiently washed with water.

This solid was dried with heating under reduced pressure to afford 38.2 g of Oleophilic Polymer Coupler (I).

The chlorine analysis of this polymer coupler showed that the formed copolymer contained 51.4% of Monomer Coupler (1).

Next, the process for dispersing the Oleophic Polymer Coupler (I) in a gelatin aqueous solution in a form or latex is illustrated. First, two kinds of the solutions (a) and (b) were prepared as follows.

Solution (a): A 3.0 weight % aqueous solution of bone gelatine (pH 5.6 at 35° C.) 200 g was heated to 38° C. and a 10 weight % aqueous solution of sodium laurylsulfate 16 ml was added thereto.

Solution (b): The above Oleophilic Polymer Coupler (I) 20 g was dissolved in ethyl acetate 200 ml at 38° C.

Solution (b) was put into a mixer with explosion preventing equipment while stirring at a high speed to which was rapidly added solution (a). After stirring for 1 minute, the mixer was stopped and ethyl acetate was removed by distillation under a reduced pressure. Thus, the oleophilic polymer coupler was dispersed in a diluted gelatin solution to prepare Polymer Coupler Latex (I').

PREPARATION EXAMPLE (2)

Synthesis of copolymer coupler of 6-acrylamide-2,4-dichloro-3-methylphenol [Monomer Coupler (2)], ethyl methacrylate and acrylic acid [Oleophilic Polymer Coupler (II)].

A mixture of the Monomer Coupler (2) 20 g, ethyl methacrylate 16 g, acrylic acid 4 g and n-propanol 200 mg was heated to 80° C. under stirring while introducing nitrogen gas, then n-propanol 10 ml containing dimethyl azobisisobutyrate 600 mg was added thereto to initiate polymerization. After recting for 5 hours, the reaction mixture was cooled and poured in water 1.5 l, and the crystallized solid was filtered and sufficiently washed with water.

This solid was dried with heating under reduced pressure to afford 37.6 g of the Oleophilic Polymer Coupler (II).

The chlorine analysis of this polymer coupler showed that the formed copolymer contained 49.8% of Monomer Coupler (2).

The process for dispersing the Oleophilic Polymer Coupler (II) in a gelatin aqueous solution in a form of latex will now be described. First, two kinds of the solutions (a) and (b) were prepared as follows.

Solution (a): A 3.0 weight % aqueous solution of bone gelatin (pH 5.6 at 35° C.) 200 g was heated to 38° C. and a 10 weight % aqueous solution of sodium laurylsulfate 16 ml was added thereto.

Solution (b): The above Oleophilic Polymer Coupler (II) 20 g was dissolved in ethyl acetate 200 ml at 38° C.

Solution (b) was put into a mixer with explosion preventing equipment while stirring at a high speed to which was rapidly added solution (a). After stirring for 1 minute, the mixer was stopped and ethyl acetate was removed by distillation under a reduced pressure. Thus, the oleophilic polymer coupler was dispersed in a diluted gelatin solution to prepare Polymer Coupler Latex (II').

PREPARATION EXAMPLE (3)

Synthesis of copolymer coupler of 6-acrylamide-2,4-dichloro-3-methylphenol [Monomer Coupler (2)], ethyl methacrylate and N-methacryloyl-β-alanine [Oleophilic Polymer Coupler (III)]

A mixture of the Monomer Coupler (2) 50 g, ethyl methacrylate 45 g, N-methacryloyl-β-alanine 5 g and dioxane 500 ml was heated to 80° C. under stirring while introducing nitrogen gas, then dioxane 30 ml containing dimethyl azobisisobutyrate 1.5 g was added thereto to initiate polymerization. After reacting for 5 hours, the reaction mixture was cooled and poured in water 7 l, and the crystallized solid was filtered and sufficiently washed with water.

The solid was dried with heating under reduced pressure to afford 94.5 g of Oleophilic Polymer Coupler (III).

The chlorine analysis of the polymer coupler indicated that the formed copolymer contained 50.1% of the Monomer Coupler (2).

The process for dispersing the Oleophilic Polymer Coupler (III) in a gelatin aqueous solution is described below. First, two kinds of the solutions (a) and (b) were prepared as follows.

Solution (a): A 3.0 weight % aqueous solution of bone gelatin (pH 5.6 at 35° C.) 200 g was heated to 38° C. and a 10 weight % aqueous solution of sodium laurylsulfate 16 ml was added thereto.

Solution (b): The above Oleophilic Polymer Coupler (III) 20 g was dissolved in ethyl acetate 200 ml at 38° C.

Solution (b) was put into a mixer with explosion preventing equipment while stirring at a high speed to which was rapidly added solution (a). After stirring for 1 minute, the mixer was stopped and ethyl acetate was removed by distillation under a reduced pressure. Thus, the oleophilic polymer coupler was dispersed in a diluted gelatin solution to prepare Polymer Coupler Latex (III').

PREPARATION EXAMPLE (4)

Synthesis of copolymer coupler of 6-(3-methacrylamidopropanamide)-2,4-dichloro-3-methylphenol [Monomer Coupler (9)], diacetone acrylamide and methacrylic acid [Oleophilic Polymer Coupler (IV)]

A mixture of n-propanol 200 ml containing the Monomer Coupler (9) 20 g, diacetoneacrylamide 17 g and methacrylic acid 3 g was heated to 80° C. under stirring while introducing nitrogen gas, then n-propnaol 10 ml containing dimethyl azobisisobutyrate 600 mg was added thereto to initiate the polymerization. After reacting for 5 hours, the reaction mixture was cooled and poured into water 1.5 l and the crystallized solid was filtered and sufficiently washed with water.

The solid was dried with heating under reduced pressure to afford 37.5 g of the Oleophilic Polymer Coupler (IV).

The chlorine analysis of the polymer coupler showed that the copolymer contained 49.3% of the Monomer Coupler (9).

The process for dispersing the Oleophilic Polymer Coupler (IV) in a gelatin solution in the form of a latex is described below. First, two kinds of the solutions (a) and (b) were prepared as follows.

Solution (a): A 3.0 weight % aqueous solution of bone gelatin (pH 5.6 at 35° C.) 200 g was heated to 38° C. and a 10 weight % aqueous solution of sodium laurylsulfate 16 ml was added thereto.

Solution (b): The above Oleophilic Polymer Coupler (IV) 20 g was dissolved in ethyl acetate 200 ml at 38° C.

Solution (b) was put into a mixer with explosion preventing equipment while stirring at a high speed to which was rapidly added solution (a). After stirring for 1 minute, the mixer was stopped and ethyl acetate was removed by distillation under a reduced pressure. Thus, the oleophilic polymer coupler was dispersed in a diluted gelatin solution to prepare Polymer Coupler Latex (IV').

PREPARATION EXAMPLES (5)–(21)

Using the monomer couplers mentioned above, the following oleophilic cyan polymer couplers were prepared in the same manner as described for the copolymers in Preparation Examples 1 to 4.

| | | Oleophilic Polymer Coupler | | | | | | |
|---|---|---|---|---|---|---|---|---|
| | | Monomer Coupler | | Monomer containing non-color forming acid component | | Non-color forming monomer | | |
| Preparation Example | Oleophilic Polymer Coupler | (kind) | (amount) (g) | (kind) | (amount) (g) | (kind) | (amount) (g) | Monomer Coupler unit in polymer (wt %) |
| 5 | V | (1) | 20 | MAA | 4 | MMA | 16 | 51.1 |
| 6 | VI | (1) | 20 | MAA | 6 | MMA | 14 | 49.8 |
| 7 | VII | (1) | 20 | MAA | 4 | EMA | 16 | 52.5 |
| 8 | VIII | (1) | 20 | MAA | 4 | t-BA | 16 | 51.7 |
| 9 | IX | (1) | 20 | M-β-AL | 4 | BA | 16 | 50.8 |
| 10 | X | (2) | 20 | MAA | 4 | EMA | 16 | 51.1 |
| 11 | XI | (2) | 20 | M-β-AL | 4 | BMA | 16 | 51.3 |
| 12 | XII | (4) | 20 | AA | 5 | MMA | 15 | 49.5 |
| 13 | XIII | (7) | 20 | M-β-AL | 4 | BA | 16 | 50.6 |
| 14 | XIV | (8) | 20 | MAA | 4 | EMA | 16 | 50.6 |
| 15 | XV | (9) | 20 | AMPS | 3 | EHA | 17 | 51.3 |
| 16 | XVI | (9) | 20 | MAA | 4 | BMA | 16 | 52.5 |
| 17 | XVII | (11) | 20 | AA | 4 | BMA | 16 | 49.6 |
| 18 | XVIII | (12) | 20 | M-β-AL | 4 | DAAM | 16 | 51.3 |
| 19 | XIX | (15) | 20 | MAA | 4 | BA | 16 | 51.7 |
| 20 | XX | (20) | 20 | AA | 4 | MMA | 16 | 50.3 |
| 21 | XXI | (21) | 20 | AMPS | 3 | BA | 17 | 52.5 |

MAA: Methacylic acid,
AA: Acrylic acid,
M-β-AL: N—Methacryloyl-β-alanine,
AMPS: 2-Methacrylamide-2-methylpropanesulfonic acid,
MMA: Methyl methacrylate,
EMA: Ethyl methacrylate,
BA: n-Butyl acrylate,
t-BA: t-Butyl acrylate,
BMA: n-Butyl methacrylate,
DAAM: Diacetoneacrylamide The amounts of the monomer couplers, the monomers containing a non-color fomring acid component and the non-color forming monomers in the above table indicate amounts used in the synthesis of the oleophilic polymer couplers.

Dispersion of these oleophilic polymer couplers in latexes can also be carried out in the same manner as Preparation Examples (1) to (4) mentioned above.

The cyan polymer coupler latexes according to the present invention can be used individually or as mixtures of two or more thereof.

The cyan polymer coupler latexes according to the present invention can also be used together with a cyan polymer coupler latex, such as those described in U.S. Pat. No. 4,080,211, West German Pat. No. 2,725,591, U.S. Pat. No. 3,926,436 and *Research Disclosure,* No. 21728, etc.

Further, a dispersion which is prepared by dispersing a hydrophobic cyan color forming coupler such as a phenol coupler or a naphthol coupler, for example, a cyan coupler, as described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76 and 73050/80, etc., in a hydrophilic colloid in a manner as described, for example, in U.S. Pat. Nos. 2,269,158, 2,272,191, 2,304,940, 2,311,020, 2,322,027, 2,360,289, 2,772,163, 2,801,170, 2,801,171 and 3,619,195, British Pat. No. 1,151,590, West German Pat. No. 1,143,707, etc., is loaded into the cyan polymer coupler latex according to the present invention in a manner as described in Japanese Patent Publication No. 39853/76, etc., and the resulting latex can be used. The term "load" used herein refers to the state in which a hydrophobic cyan coupler is incorporated into the interior of a cyan polymer coupler latex, or a state in which a hydrophobic cyan coupler is deposited on the surface of a cyan polymer coupler latex. However, the mechanism by which the load occurs is not accurately known.

In order to satisfy the characteristics required for the photographic light-sensitive material, a dispersion which is prepared by dispersing a development inhibitor releasing (DIR) coupler as described, for example, in U.S. Pat. Nos. 3,148,062, 3,227,554, 3,733,201, 3,617,291, 3,703,375, 3,615,506, 3,265,506, 3,620,745, 3,632,345, 3,869,291, 3,642,485, 3,770,436 and 3,808,945, British Pat. Nos. 1,201,110 and 1,236,767, etc., in a hydrophilic colloid in a manner as described in U.S. Pat. Nos. 2,269,158, 2,272,191, 2,304,940, 2,311,020, 2,322,027, 2,360,289, 2,772,163, 2,801,170, 2,801,171 and 3,619,195, British Pat. No. 1,151,590, West German Pat. No. 1,143,707, etc., is loaded into the cyan polymer coupler latex according to the present invention in a manner as described in Japanese Patent Publication No. 39853/76.

Furthermore, the cyan polymer coupler latex according to the present invention can be used together with a DIR compound as described, for example, in West German Patent Application (OLS) Nos. 2,529,350, 2,448,063 and 2,610,546, U.S. Pat. Nos. 3,928,041, 3,958,993, 3,961,959, 4,049,455, 4,052,213, 3,379,529, 3,043,690, 3,364,022, 3,297,445 and 3,287,129.

Moreover, the cyan polymer coupler latex according to the present invention can be used in combination with a competing coupler as described, for example, in U.S. Pat. Nos. 3,876,428, 3,580,722, 2,998,314, 2,808,329, 2,742,832 and 2,689,793, etc., a stain preventing agent as described, for example, in U.S. Pat. Nos. 2,336,327, 2,728,659, 2,336,327, 2,403,721, 2,701,197 and 3,700,453, etc., a dye image stabilizing agent as described, for example, in British Pat. No. 1,326,889, U.S. Pat. Nos. 3,432,300, 3,698,909, 3,574,627, 3,573,050 and 3,764,337, etc., or the like.

The color photographic light-sensitive material produced according to the present invention can also contain conventionally well known coupler(s) other than a cyan color forming coupler. A non-diffusible coupler which contains a hydrophobic group, called a ballast group, in the molecule thereof is preferred as a coupler. A coupler can have either a 4-equivalent or a 2-equivalent property with respect to the silver ion. In addition, a colored coupler providing a color correction effect, or a coupler which releases a development inhibitor upon a development can also be present therein. Furthermore, a coupler which provides a colorless product upon coupling can be employed.

A known open chain ketomethylene type coupler can be used as a yellow color forming coupler. Of these couplers, benzoyl acetanilide type and pivaloyl acetanilide type compounds are especially effective. Specific examples of yellow color forming couplers which can be employed are described, for example, in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361, and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76 and 87650/75, etc.

A 5-pyrazolone coupler, a pyrazolobenzimidazole coupler, a cyanoacetylcumaron coupler, an open chain acylacetonitrile coupler, etc. can be used as a magenta color forming coupler. Specific examples of magenta color forming couplers which can be employed are described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,419,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78, etc.

Two or more kinds of the couplers described above can be incorporated into the same layer, or the same coupler compound can also be present in two or more layers.

A known method, for example, the method described in U.S. Pat. No. 2,322,027, can be used in order to incorporate the couplers described above into a silver halide emulsion layer. The coupler is dispersed in a hydrophilic colloid and then mixed with a silver halide emulsion. For example, the coupler may be dissolved in an organic solvent having a high boiling point, for example, a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethyl laurylamide, etc.), a fatty acid ester (e.g., dibutoxyethyl succinate, dioctyl azelate, etc.), a trimesic acid ester (e.g., tributyl trimesate, etc.), etc., or in an organic solvent having a low boiling point of from about 30 to about 150° C., for example, a lower alkyl acetate (e.g., ethyl acetate, butyl acetate, etc.), ethyl propionate, sec-butyl alcohol, methyl isobutyl ketone, β-ethoxyethyl acetate, methyl cellosolve acetate, etc., and then the solution is dispersed in a hydrophilic colloid. The above described organic solvent having a high boiling point and the above described organic solvent having a low boiling point may be used as mixture, if desired.

Furthermore, the dispersing method using a polymeric material as described in Japanese Patent Publication No. 39853/76 and Japanese Patent Application (OPI) No. 59943/76 can also be used.

When a coupler having an acid group, such as a carboxylic acid group, a sulfonic acid group, etc., is used, it can be incorporated in a hydrophilic colloid as an alkaline aqueous solution thereof.

The silver halide emulsions which can be used in the present invention are those wherein silver chloride, silver bromide, or a mixed silver halide such as silver chlorobromide, silver iodobromide, or silver chloroiodobromide is finely dispersed in a hydrophilic polymer such as gelatin. The silver halide can be chosen depending on the intended use of the photographic light-sensitive material from dispersions having a uniform grain size or those having a wide grain size distribution or from dispersions having an average grain size of from about 0.1 micron to 3 microns. These silver halide emulsions can be prepared, for example, by a single jet method, by a double jet method or a controlled double jet method, or by a ripening method such as an ammonia method, a neutral method, or an acid method. Also, these silver halide emulsions can be subjected to chemical sensitization such as a sulfur sensitization, a gold sensitization, a reduction sensitization, etc., and can contain a speed increasing agent such as a polyoxyethylene compound, an onium compound, etc. Further, a silver halide emulsion of the type wherein latent images are predominantly formed on the surface of the grains or of the type where latent images are predominantly formed inside the grains can be used in the present invention. Also, two or more kinds of silver halide photographic emulsions prepared separately and then mixed can be employed.

Suitable examples of a hydrophilic high molecular weight substance composed of the photographic light-sensitive layer of the present invention include a protein such as gelatin, etc., a high molecular weight non-electrolyte such as polyvinyl alcohol, polyvinyl pyrrolidone, polyacrylamide, etc., an acidic high molecular weight substance such as an alginate, a polyacrylic acid salt, etc., a high molecular weight ampholite such as a polyacrylamide treated with the Hoffman rearrangement reaction, a copolymer of acrylic acid and N-vinylimidazole, etc., a cross-linkable polymer such as those described in U.S. Pat. No. 4,215,195, and the like. Furthermore, a dispersion of a hydrophobic high molecular weight substance such as a latex of polybutyl acrylate, etc., can be included in the continuous phase of such a hydrophilic high molecular weight substance.

The silver halide emulsion used in the present invention can be chemically sensitized, as noted above, using conventional methods. Examples of suitable chemical sensitizers include, for example, a gold compound such as a chloroaurate and gold trichloride, as described in U.S. Pat. Nos. 2,399,083, 2,540,085, 2,597,856, and 2,597,915; a salt of a noble metal, such as platinum, palladium, iridium, rhodium and ruthenium, as described in U.S. Pat. Nos. 2,448,060, 2,540,086, 2,566,245, 2,566,263 and 2,598,079; a sulfur compound capable of forming silver sulfide by reacting with a silver salt, such as those described in U.S. Pat. Nos. 1,574,944, 2,410,689, 3,189,458 and 3,501,313; a stannous salt, an amine, and other reducing compounds such as those described in U.S. Pat. Nos. 2,487,850, 2,518,698, 2,521,925, 2,521,926, 2,694,637, 2,983,610 and 3,201,254 and the like.

Various compounds can be added to the photographic emulsions used in the present invention in order to prevent a reduction of the sensitivity or a formation of fog during preparation, storage, or processing. A wide variety of such compounds are known, such as a heterocyclic compound, mercury-containing compound, a mercapto compound or a metal salt, including 4-hydroxy-6-methyl-1,3,3a,7-tetraazaindene, 3-methylbenzothiazole and 1-phenyl-5-mercaptotetrazole, etc. Other examples of such compounds which can be used are described, for example, in U.S. Pat. Nos. 1,758,576, 2,110,178, 2,131,038, 2,173,628, 2,697,040, 2,304,962, 2,324,123, 2,349,198, 2,444,605-8, 2,566,245, 2,694,716, 2,697,099, 2,708,162, 2,728,663-5, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339, British Pat. Nos. 893,428, 403,789, 1,173,609 and 1,200,188, as well as in K. Mees, *The Theory of the Photographic Process,* 3rd Ed. (1966) and the literature references cited therein.

The photographic emulsion used in the present invention can also contain a surface active agent individually or as a mixture thereof. These surface active agents are commonly used as a coating aid. However, in some cases they are used for the purposes of emulsion dispersion, sensitization, static prevention, adhesion prevention, etc.

The surface active agents can be classified into various groups, as follows: a natural surface active agent such as saponin, etc.; a nonionic surface active agent such as an alkylene oxide, a glycerol and a glycidol, etc.; a cationic surface active agent such as a higher alkylamine, a quaternary ammonium salt, a heterocyclic compound such as pyridine and the like, a phosphoniums, a sulfoniums, etc.; an anionic surface active agent containing an acid group such as a carboxylic acid group, a sulfonic acid group, a phosphoric acid group, a sulfuric acid ester group, a phosphoric acid ester group, etc.; an amphoteric surface active agent such as an amino acid, an aminosulfonic acid, an aminoalcohol sulfuric acid ester, an aminoalcohol phosphoric acid ester, etc. Some examples of those surface active agents which can be used are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, West German Patent Application (OLS) No. 1,942,665, British Pat. Nos. 1,077,317 and 1,198,450, as well as Ryohei Oda et al., *Kaimenkasseizai no Gosei to Sono Oyo* (*Synthesis and Application of Surface Active Agents*), Maki Shoten (1964), A. W. Perry, *Surface Active Agents,* Interscience Publications, Inc. (1958) and J. P. Sisley, *Encyclopedia of Surface Active Agents,* Vol. II, Chemical Publishing Co. (1964), etc.

The photographic emulsion can be spectrally sensitized, or supersensitized, using a cyanine-type dye, such as a cyanine, merocyanine, carbocyanine, etc., individually, in combination, or in combination with a styryl dye.

These spectral sensitization techniques are well known, and are described, for example, in U.S. Pat. Nos. 2,688,545, 2,912,329, 3,397,060, 3,615,635 and 3,628,964, British Pat. Nos. 1,195,302, 1,242,588 and 1,293,862, West German Patent Application (OLS) Nos. 2,030,326 and 2,121,780, Japanese Patent Publication Nos. 4936/68 and 14030/69, etc. The sensitizers can be selected as desired depending on the wavelength range, sensitivity, etc. due to the purpose and use of the photographic light-sensitive material to be sensitized.

The hydrophilic colloid layer, and in particular a gelatin layer in the photographic light-sensitive material used in the present invention, can be hardened using various kinds of cross-linking agents. For instance, an inorganic compound such as a chromium salt, a zirconium salt, etc. or an aldehyde type cross-linking agent such as mucochloric acid, or 2-phenoxy-3-chloromalealdehydic acid as described in Japanese Patent Publication No. 1872/71 can be effectively used in the present invention. However, a non-aldehyde type cross-linking agent such as a compound having plural epoxy rings as described in Japanese Patent Publication No. 7133/59, a poly(1-aziridinyl) compound as described in Japanese Patent Publication No. 8790/62, an active halogen compound as described in U.S. Pat. Nos. 3,362,827 and 3,325,287, a vinyl sulfone compound as described in U.S. Pat. Nos. 2,994,611 and 3,582,322, Belgian Patent No. 686,440, etc., are particularly suitable for use in the photographic light-sensitive material of the present invention.

The silver halide photographic emulsion according to the present invention is suitably applied to a support. Illustrative supports include a rigid material such as glass, a metal and a ceramic, and a flexible material and the type of support chosen depends on the end-use objects. Typical examples of flexible supports include a cellulose nitrate film, a cellulose acetate film, a polyvinyl acetal film, a polystyrene film, a polyethylene terephthalate film, a polycarbonate film and a laminate thereof, a baryta coated paper, a paper coated with an α-olefin polymer, such as polyethylene, polypropylene and an ethylene-butene copolymer, a plastic film having a roughened surface as described in Japanese Patent Publication No. 19068/72, and the like. Depending upon the end-use objects of the photographic light-sensitive material, the support can be transparent, colored by adding a dye or pigment, opaque by adding, for example, titanium white, or light-shielding by adding, for example, carbon black.

The layer of the photographic light-sensitive material can be coated on a support using various coating methods, including a dip coating method, an air-knife coating method, a curtain coating method, an extrusion coating method using a hopper as described in U.S. Pat. No. 2,681,294. Also, two or more layers can be coated simultaneously, using methods as described in U.S. Pat. Nos. 2,761,791, 3,508,947, 2,941,898, 3,526,528, etc.

In practice of the present invention, a known fade-preventing agent can be used. A color image stabilizing agent can be used alone individually or in combination two or more thereof. Examples of known fade-preventing agents include a hydroquinone derivative, a gallic acid derivative, a p-alkoxyphenol, a p-oxyphenol derivative or a biphenol, etc.

Specific examples of hydroquinone derivatives are described in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921, etc. Specific examples of gallic acid derivatives are described in U.S. Pat. Nos. 3,457,079 and 3,069,262, etc. Specific examples of p-alkoxyphenols are described in U.S. Pat. Nos. 2,735,765 and 3,698,909, Japanese Patent Publication Nos. 20977/74 and 6623/77, etc. Specific examples of p-oxyphenol derivatives are described in U.S. Pat. Nos. 3,432,300, 3,573,050, 3,574,627 and 3,764,337, Japanese Patent Application (OPI) Nos. 35633/77, 147434/77, and 152225/77, etc. Specific examples of bisphenols are described in U.S. Pat. No. 3,700,455.

The photographic light-sensitive material of the present invention may contain a ultraviolet light absorbing agent in a hydrophilic colloid layer. For example, a benzotriazole compound substituted with an aryl group (for example, those described in U.S. Pat. No. 3,533,794), a 4-thiazolidone compound (for example, those described in U.S. Pat. Nos. 3,314,794 and 3,352,681), a benzophenone compound (for example, those described in Japanese Patent Application (OPI) No. 2784/71), a cinnamic ester compound (for example, those described in U.S. Pat. Nos. 3,705,805 and 3,707,375), and a benzoxazole compound (for example, those described in U.S. Pat. No. 3,499,762) can be employed. An ultraviolet light absorbing coupler (for example, α-naphthol type cyan dye forming coupler) and an ultraviolet light absorbing polymer can also be employed. These ultraviolet light absorbing agents may be mordanted to a specific layer. Also, these ultraviolet light absorbing agents may be contained within the layer containing the cyan polymer coupler of the present invention.

The present invention is applicable to not only the so-called multilayer type photographic light-sensitive material comprising a support having superimposed thereon emulsion layers, each of which is sensitive to radiation of a substantially different wavelength region and forms color images of a substantially different hue, but also the so-called mixed packet type photographic light-sensitive material comprising a support having coated thereon a layer containing packets which are sensitive to radiation of substantially different wavelength regions and form color images of a substantially different hue. The present invention can be applied to a color negative film, a color positive film, a color reversal film, a color printing paper, a color reversal printing paper, and the like.

The color photographic light-sensitive material of the present invention is, after exposure, subjected to a development processing to form dye images. Development processing includes basically a color development step, a bleaching step and a fixing step. Each step can be carried out individually or two or more steps can be combined as one step where a processing solution having two or more functions is used. Also, each step can be separated into two or more steps. The development processing can further include a pre-hardening step, a neutralization step, a first development (black-and-white development) step, a stabilizing step, a water washing step, and the like, if desired. The temperature of processing can be varied depending on the photographic light-sensitive material, the processing method, and the like. In general, the processing steps are carried out at a temperature from 18° C. to 60° C. These steps need not necessarily be conducted at the same temperature.

A color developer solution is an alkaline solution having a pH of more than 8, preferably from 9 to 12, and containing, as a developing agent, a compound whose oxidation product is capable of forming a colored compound when reacted with a color forming agent, i.e., a color coupler. The developing agent described above include a compound capable of developing an exposed silver halide and having a primary amino group on an aromatic ring, and a precursor which forms such compound. Typical examples of preferred developing agents are, for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-N,N-dimethylaniline, 4-amino-3-methoxy-N,N-diethylaniline, 4-amino-3-methyl-N-ethyl-N-β-ethoxyethylaniline, 4-amino-3-methoxy-N-ethyl-N-β-methoxyethylaniline, 4-amino-3-β-methanesulfonamidoethyl-N,N-diethylaniline, and a salt thereof (for example, a sulfate, a hydrochloride, a sulfite, a p-toluene sulfonate, and the like). Other developing agents such as those described in U.S. Pat. Nos. 2,193,015 and 2,592,364, Japanese Patent Application (OPI) No. 64933/73, L. F. A. Mason, *Photographic Processing Chemistry,* pages 226–229, Focal Press, London (1966), T. H. James, *The Theory of the Photographic Process,* 4th Edition, pages 315–320, Macmillan, New York (1977), etc., can be used. Further, an aminophenol as described in T. H. James, *The Theory of the Photographic Process,* 4th Edition, pages 311–315, etc., can be used. Also, a 3-pyrazolidone developing agent can be used together with these developing agents.

The color developing solution can optionally contain various additives. Typical examples of such additives include an alkaline agent (for example, an alkali metal or ammonium hydroxide, carbonate or phosphate, etc.); a pH-adjusting agent or buffer (for example, a weak acid such as acetic acid, boric acid, etc., a weak base, or salt thereof, etc.); a developing accelerator (for example, various pyridinium compounds or cationic compounds such as those described in U.S. Pat. Nos. 2,648,604 and 3,671,247; potassium nitrate; sodium nitrate; a condensation product of polyethylene glycol, and a derivative thereof such as those described in U.S. Pat. Nos. 2,533,990, 2,577,127 and 2,950,970; a nonionic compound such as a polythioether represented by those described in British Pat. Nos. 1,020,033 and 1,020,032; a polymeric compound having a sulfite ester group such as those described in U.S. Pat. No. 3,068,097; an organic amine such as pyridine and ethanolamine; benzyl alcohol; a hydrazine and the like); an anti-fogging agent (for example, an alkali metal bromide; an alkali metal iodide; a nitrobenzimidazole such as those described in U.S. Pat. Nos. 2,496,940 and 2,656,271; mercaptobenzimidazole; 5-methylbenztriazole; 1-phenyl-5-mercaptotetrazole; a compound for use in rapid processing such as those described in U.S. Pat. Nos. 3,113,864, 3,342,596, 3,295,976, 3,615,522 and 3,597,199; a thiosulfonyl compound such as those described in British Pat. No. 972,211; a phenazine-N-oxide such as those described in Japanese Patent Publication No. 41675/71; fog inhibiting agents described in *Kagaku Shashin Binran* (*Manual of Scientific Photography*), Vol. II, pages 29–47, and the like); a stain or sludge preventing agent such as those described in U.S. Pat. Nos. 3,161,513 and 3,161,514, and British Pat. Nos. 1,030,442, 1,144,481 and 1,251,558; an interlayer-effect accelerator disclosed in U.S. Pat. No. 3,536,487; a preservative (for example, a sulfite, a bisulfite, hydroxyamine hydrochloride, formsulfite, a alkanolaminesulfite adduct, etc.) and the like.

The color photographic light-sensitive material of the present invention can be treated with various solutions prior to color development.

In the case of color reversal films, treatment with a first development solution is also carried out prior to the color development. As the first development solution, an alkaline aqueous solution containing at least one developing agent, such as hydroquinone, 1-phenyl-3-pyrazolidone, N-methyl-p-aminophenol and the like can be employed. The solution can also contain an inorganic salt such as sodium sulfate, etc.; a pH-adjusting agent or buffer such as borax, boric acid, sodium hydroxide and sodium carbonate, etc.; a development fog preventing agent such as an alkali metal halide (such as potassium bromide, etc.), and the like.

The additives illustrated above and the amounts thereof employed are well known in the color processing field.

After color development, the color photographic materials are usually bleached and fixed. The process can be effected in a blix bath which combines the bleaching and fixing steps. Various known compounds can be used as a bleaching agent, for example, a ferricyanide, a dichromate; a water-soluble iron (III) salt, a water-soluble cobalt (III) salt; a water-soluble copper (II) salt; a water-soluble quinone; a nitrosophenol, a complex salt of a-polyvalent cation such as iron (III), cobalt (III), copper (II), etc., and an organic acid, for example, a metal complex of an aminopolycarboxylic acid such as ethylenediaminetetraacetic acid, nitrilotriacetic acid, iminodiacetic acid, N-hydroxyethylethylenediaminetriacetic acid, etc., malonic acid, tartaric acid, malic acid, diglycolic acid and dithioglycolic acid, and a copper complex salt of 2,6-dipicolinic acid; a peracid such as an alkylperacid, a persulfate, a permanganate and hydrogen peroxide; hypochlorite; chlorine; bromine; bleaching powder; and the like. These can be suitably used, individually or in combination. To the belaching solution, a bleaching accelerator such as those described in U.S. Pat. Nos. 3,042,520 and 3,241,966, Japanese Patent Publication Nos. 8506/70 and 8836/70 and various other additives can be added.

Any known fixing solution can be used for fixing the photographic material of the present invention. That is, ammonium, sodium, or potassium thiosulfate can be used as a fixing agent at a concentration of about 50 to about 200 g/liter. Fixing solution can further contains a stabilizer such as a sulfite and a metabisulfite; a hardener such as potassium alum; a pH buffer such as an acetate and a borate, and the like. The fixing solution generally has a pH of more than 3 or less.

Bleaching bath, fixing bath and blixing bath as described, for example, in U.S. Pat. No. 3,582,322, Japanese Patent Application (OPI) No. 101934/73, West German Patent No. 1,051,117, etc. can also be employed.

The present invention will be explained in greater detail with reference to the following examples, but the present invention should not be construed as being limited thereto.

EXAMPLE 1

On a paper support both surfaces of which were laminated with polyethylene were coated a first layer (undermost layer) to a sixth layer (uppermost layer) as shown below in order to prepare a color photographic light-sensitive material which is designated Sample 1. In the following layers, a coating amount is set forth in mg/m$^2$.

| | |
|---|---|
| Sixth Layer: (Protective layer) | Gelatin (1,000 mg/m$^2$) |
| Fifth Layer: (Red-sensitive layer) | Silver chlorobromide emulsion (Silver bromide: 50 mol %; silver: 300 mg/m$^2$) Cyan coupler*1 (400 mg/m$^2$), Coupler solvent*2 (400 mg/m$^2$), Gelatin (1,000 mg/m$^2$) |
| Fourth Layer: (Intermediate layer) | Ultraviolet light absorbing agent*3 (1,000 mg/m$^2$), Ultraviolet light absorbing agent solvent*2 (250 mg/m$^2$), Gelatin (1,200 mg/m$^2$) |
| Third Layer: (Green-sensitive layer) | Silver chlorobromide emulsion (silver bromide: 50 mol %; silver: 290 mg/m$^2$) Magenta coupler*4 (200 mg/m$^2$), Coupler solvent*5 (200 mg/m$^2$), Gelatin (1,000 mg/m$^2$) |
| Second Layer: (Intermediate layer) | Gelatin (1,000 mg/m$^2$) |
| First Layer: (Blue-sensitive layer) | Silver chlorobromide emulsion (Silver bromide: 80 mol %; silver: 400 mg/m$^2$) Yellow coupler*6 (300 mg/m$^2$) Coupler solvent*7 (150 mg/m$^2$) Gelatin (1,200 mg/m$^2$) |
| Support: | Paper support both surfaces of which were laminated with polyethylene |

*1 Cyan coupler: 2-[α-(2,4-Di-tert-pentylphenoxy)-butanamido]-4,6-dichloro-5-methylphenol
*2 Coupler solvent: Dibutyl phthalate
*3 Ultraviolet light absorbing agent: 2-(2-Hydroxy-3-sec-butyl-5-tert-butylphenyl)-benzotriazole
*4 Magenta coupler: 1-(2,4,6-Trichlorophenyl)-3-(2-chloro-5-tetradecanamido)anilino-2-pyrazolin-5-one
*5 Coupler solvent: Tricresyl phosphate
*6 Yellow coupler: α-Pivaloyl-α-(2,4-dioxo-5,5-dimethyloxazolidin-3-yl)-2-chloro-5-[α-(2,4-di-tert-pentyl-phenoxy)butanamido]-acetanilide
*7 Coupler solvent: Dioctyl butyl phosphate Sample 2 was prepared in the same manner as described in Sample 1 except that the cyan coupler solvent in Sample 1 was eliminated. Also, Sample 3 was prepared in the same manner as described in Sample 1 except that 400 mg/m$^2$ of latex of an oleophilic cyan polymer coupler having the following formula was used in place of the cyan coupler in Sample 1 and that the cyan coupler solvent was eliminated.

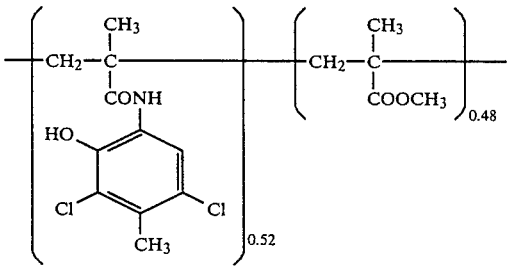

Further, Samples 4 and 5 were prepared in the same manner as described in Sample 1 except that latexes of 400 mg/m$^2$ of Oleophilic Cyan Polymer Coupler (I) and 400 mg/m$^2$ of Oleophilic Cyan Polymer Coupler (VI) according to the present invention were used respectively in place of the cyan coupler in Sample 1 and that the cyan coupler solvent was eliminated.

Each sample was exposed to red light through a continuous wedge and subjected to development processing in the following manner.

| Processing Step | Temperature | Time |
|---|---|---|
| Color Development | 33° C. | 3 min 30 sec |
| Bleach-Fixing | 33° C. | 1 min 30 sec |
| Washing with Water | 30° C. | 3 min |
| Drying | | |

The processing solutions used in the color development processing had the following compositions:

| | |
|---|---|
| Color Development Solution | |
| Benzyl Alcohol | 15 ml |
| Sodium Sulfite | 5 g |
| Potassium Bromide | 0.4 g |
| Hydroxylamine Sulfate | 2 g |
| 4-(N—Ethyl-N—β-methanesulfonamido)-2-methylaniline sesquisulfate | 2 g |
| Sodium Carbonate (monohydrate) | 30 g |
| Water to make | 1000 ml (pH 10.1) |
| Bleach-Fixing Solution | |
| Ferric Ethylenediaminetetraacetate | 45 g |
| Sodium Sulfite | 10 g |
| Ammonium Thiosulfate (70% aq. sol) | 160 ml |
| Sodium Ethylenediaminetetraacetate | 5 g |
| Water to make | 1000 ml (pH 6.8) |

The color density in each sample after development processing was measured. The fog, gamma and maximum density in each sample are shown in Table 1 below.

TABLE 1

| Sample | Fog | Gamma | Maximum Density | Remarks |
|---|---|---|---|---|
| 1 | 0.12 | 3.03 | 2.97 | Comparison |
| 2 | 0.12 | 2.97 | 3.10 | Comparison |
| 3 | 0.12 | 2.50 | 2.42 | Comparison |
| 4 | 0.12 | 3.07 | 3.15 | Invention |
| 5 | 0.11 | 3.01 | 3.09 | Invention |

As is apparent from the results shown in Table 1 above, in Sample 3 containing the latex of oleophilic cyan polymer coupler for comparison the color formation was inferior. On the contrary, Samples 4 and 5 containing the latexes of the oleophilic cyan polymer coupler according to the present invention had the excellent color forming property.

Further, Samples 1 to 5 after development processing were maintained in an almost dry atmosphere at 80° C. for 3 weeks and then the density reduction rates of the cyan color image in the areas where the initial densities were 1.0 (D 1.0) and 2.0 (D 2.0) were measured. The results thus obtained are shown in Table 2 below.

TABLE 2

| | 80° C., 3 Weeks | | |
|---|---|---|---|
| Sample | D 1.0 (%) | D 2.0 (%) | Remarks |
| 1 | 48 | 55 | Comparison |
| 2 | 50 | 53 | Comparison |
| 3 | 27 | 25 | Comparison |
| 4 | 15 | 14 | Invention |
| 5 | 11 | 9 | Invention |

In Table 2, the lower the density reduction rate (%) is, the superior the heat fastness is. It is apparent from the results shown in Table 2 above that the cyan couplers according to the present invention have superior heat fastness to that of Samples 1 to 3 for comparison.

EXAMPLE 2

On a cellulose triacetate support were coated a first layer (undermost layer) to a sixth layer (uppermost layer) as shown below in order to prepare a multilayer color photographic light-sensitive material which is designated Sample 6. In the following layers, a coating amount is set forth in mg/m$^2$.

| | |
|---|---|
| Sixth Layer: (Protective layer) | Gelatin (750 mg/m$^2$) |
| Fifth Layer: (Green-sensitive layer) | Silver chlorobromide emulsion (Silver bromide: 30 mol %; silver: 500 mg/m$^2$)<br>Magenta coupler*1 (600 mg/m$^2$)<br>Coupler solvent*2 (110 mg/m$^2$)<br>Gelatin (1,300 mg/m$^2$) |
| Fourth Layer: (Intermediate layer) | Gelatin (500 mg/m$^2$) |
| Third Layer: (Red-sensitive layer) | Silver chlorobromide emulsion (Silver bromide: 30 mol %; silver: 500 mg/m$^2$)<br>Cyan coupler*3 (1,500 mg/m$^2$)<br>Coupler solvent*4 (700 mg/m$^2$)<br>Gelatin (2,900 mg/m$^2$) |
| Second Layer: (Intermediate layer) | Gelatin (500 mg/m$^2$) |
| First Layer: (Blue-sensitive layer) | Silver iodobromide emulsion (Silver iodide: 0.2 mol %; silver 1000 mg/m$^2$)<br>Yellow coupler*5 (1,200 mg/m$^2$)<br>Coupler solvent*2 (600 mg/m$^2$)<br>Gelatin (2,200 mg/m$^2$) |
| Support | Cellulose triacetate |

*1Magenta coupler: 3-{3-[2-(2,4-Di-tert-amylphenoxy)-acetamido]benzamido}-1-(2,4,6-trichlorophenyl)-2-pyrazolin-5-one
*2Coupler solvent: Tricresyl phosphate
*3Cyan coupler: 2-[α-(2,4-Di-tert-pentylphenoxy)-butanamido]-4,6-dichloro-5-methylphenol
*4Coupler solvent: Dibutyl phthalate
*5Yellow coupler: α-Pivaloyl-α-(2,4-dioxo-5,5-dimethyloxazolidin-3-yl)-2-chloro-5-[α-(2,4-di-tert-pentylphenoxy)-butanamido]acetanilide Sample 7 was prepared in the same manner as described in Sample 6 except that the cyan coupler solvent in Sample 6 was eliminated. Also, Sample 8 was prepared in the same manner as described in Sample 6 except that 1,500 mg/m$^2$ of the oleophilic cyan polymer coupler for comparison having the following formula was used in place of the cyan coupler in Sample 6 and that the cyan coupler solvent was eliminated.

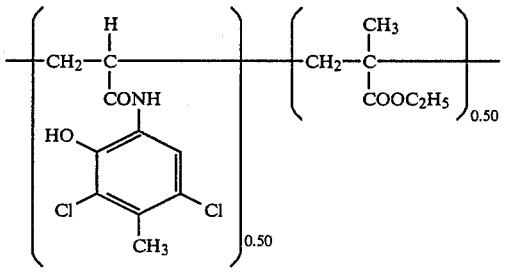

Further, Samples 9, 10 and 11 were prepared in the same manner as described in Sample 8 except that 1500 mg/m$^2$ of Oleophilic Cyan Polymer Coupler (X), 1500 mg/m$^2$ of Oleophilic Cyan Polymer Coupler (II) and 1500 mg/m$^2$ of Oleophilic Cyan Polymer Coupler (XI) according to the present invention were used respectively in place of the oleophilic cyan polymer coupler for comparison in Sample 8.

Each sample was exposed to blue light, green light and red light through a continuous wedge and subjected to the following development processing.

| Processing Step | Temperature | Time |
|---|---|---|
| Color Development | 36° C. | 3 min |
| Stopping | 36° C. | 40 sec |
| First Fixing | 36° C. | 40 sec |
| Bleaching | 36° C. | 1 min |
| Second Fixing | 36° C. | 40 sec |
| Washing with Water | 30° C. | 30 sec |
| Drying | | |

The processing solution used in the color development processing had the following compositions:

| | |
|---|---|
| **Color Development Solution** | |
| Sodium Sulfite | 5 g |
| 4-Amino-3-methyl-N,N—diethylaniline | 3 g |
| Sodium Carbonate | 20 g |
| Potassium Bromide | 2 g |
| Water to make | 1 liter (pH 10.5) |
| **Stopping Solution** | |
| 6 N Sulfuric Acid | 50 ml |
| Water to make | 1 liter (pH 1.0) |
| **Fixing Solution** | |
| Ammonium Thiosulfate | 60 g |
| Sodium Sulfite | 2 g |
| Sodium Hydrogen Sulfite | 10 g |
| Water to make | 1 liter (pH 5.8) |
| **Bleaching Solution** | |
| Potassium Ferricyanide | 30 g |
| Potassium Bromide | 15 g |
| Water to make | 1 liter (pH 6.5) |

The color density at the portion exposed to red light in each sample after development processing was measured. The fog, gamma and maximum density in each sample are shown in Table 3 below.

Further, Samples 6 to 11 after development processing were maintained in an almost dry atmosphere at 80° C. for 2 weeks and then the density reduction rates of the cyan color image in the areas where the initial densities were 1.0 (D 1.0) and 2.0 (D 2.0) were measured. The results thus obtained are shown in Table 4 below.

TABLE 3

| Sample | Fog | Gamma | Maximum Density | Remarks |
|---|---|---|---|---|
| 6 | 0.07 | 3.12 | 3.42 | Comparison |
| 7 | 0.06 | 2.99 | 3.01 | Comparison |
| 8 | 0.07 | 2.33 | 2.45 | Comparison |
| 9 | 0.06 | 3.06 | 3.15 | Invention |
| 10 | 0.07 | 3.09 | 3.21 | Invention |
| 11 | 0.06 | 3.08 | 3.18 | Invention |

TABLE 4

| | 80° C., 2 Weeks | | |
|---|---|---|---|
| Sample | D 1.0 (%) | D 2.0 (%) | Remarks |
| 6 | 72 | 75 | Comparison |
| 7 | 65 | 64 | Comparison |
| 8 | 63 | 22 | Comparison |
| 9 | 10 | 9 | Invention |
| 10 | 12 | 10 | Invention |

TABLE 4-continued

| Sample | 80° C., 2 Weeks D 1.0 (%) | D 2.0 (%) | Remarks |
|---|---|---|---|
| 11 | 9 | 7 | Invention |

As is apparent from the results shown in Table 3 and 4 above, Samples 9, 10 and 11 according to the present invention had excellent color forming property and heat fastness as compared with Samples 6 to 8 for comparison.

EXAMPLE 3

Sample 31 was prepared in the same manner as Sample 3 in Example 1.

Sample 32 was prepared in the same manner as Sample 31 except that the latex of the oleophilic cyan polymer coupler in Sample 31 was replaced by 400 mg/m$^2$ (copolymer weight) of a Polymer Coupler Latex A which was synthesized using 6-methacrylamido-2,4-dichloro-3-methylphenol as a coupler monomer and methyl methacrylate and methacrylic acid as non-color forming monomers according to the method described in Example 4 of U.S. Pat. No. 4,080,211 (wherein water/methyl alcohol was used as polymerizing solvent).

Samples 33 and 34 were prepared in the same manner as Sample 32 except that the Polymer Coupler Latex A in Sample 32 were replaced by 400 mg/m$^2$ (copolymer weight) of Polymer Coupler Latex B and 400 mg/m$^2$ (copolymer weight) of Polymer Coupler Latex C, respectively, which were synthesized using ethyl methacrylate and t-butyl acrylate, respectively, instead of methyl methacrylate among the non-color forming monomers of Polymer Coupoler Latex A in Sample 32.

Samples 35, 36 and 37 were prepared in the same manner as Sample 31 except that the oleophilic cyan polymer coupler in Sample 31 was replaced by 400 mg/m$^2$ of Oleophilic Cyan Polymer Couplers (V), (VII) and (VIII) of the present invention, respectively.

Each sample was exposed to red light through a continuous wedge and subjected to the same development processing as in Example 1.

The color density in each sample after development processing was measured. The fog, gamma and maximum density in each sample are shown in Table 5 below.

TABLE 5

| Sample | Fog | Gamma | Maximum Density | Remarks |
|---|---|---|---|---|
| 31 | 0.12 | 2.50 | 2.42 | Comparison |
| 32 | 0.11 | 2.29 | 1.98 | Comparison |
| 33 | 0.12 | 2.33 | 1.95 | Comparison |
| 34 | 0.13 | 2.47 | 2.24 | Comparison |
| 35 | 0.12 | 3.12 | 3.27 | Invention |
| 36 | 0.12 | 3.08 | 3.15 | Invention |
| 37 | 0.12 | 3.06 | 3.11 | Invention |

It is apparent from the results in Table 5 above that the oleophilic cyan polymer couplers of the present invention have superior color forming property to that of the cyan polymer coupler latexes for comparison used in Samples 31 to 34.

While the invention has been described in detail and with reference to specific embodiment thereof, it will be apparent to one skilled in the art that various changes and modifications can be made therein without departing from the spirit and scope thereof.

What is claimed is:

1. A silver halide color photographic light-sensitive material, comprising:

a support base having thereon;

a silver halide emulsion layer containing a cyan dye-forming oleophilic polymer coupler comprised of three repeating units including a cyan coupler repeating unit corresponding to general formula (I), an ethylene type unsaturated monomer repeating unit corresponding to general formula (II) which contains an acid component and an ethylene type unsaturated monomer repeating unit from group (III); wherein the cyan dye-forming oleophilic polymer coupler is prepared by dissolving the monomeric components thereof in an organic solvent and polymerizing the same therein and is present in the form of a dispersed product, said polymer coupler having been dissolved in an organic solvent followed by emulsion dispersion in a gelatin aqueous solution in the presence of a surfactant;

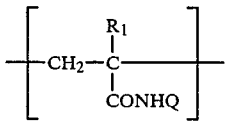

(I)

wherein $R_1$ represents a hydrogen atom, a lower alkyl group containing 1 to 4 carbon atoms or a chlorine atom, and Q represents a cyan coupler residue capable of forming a dye upon coupling with an oxidized aromatic primary amine developing agent;

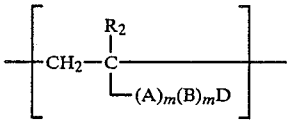

(II)

wherein $R_2$ represents a hydrogen atom, a lower alkyl group containing 1 to 4 carbon atoms or a chlorine atoms, a represents —COO— or —CONH—, B represents an alkylene, aralkylene or phenylene group containing 1 to 10 atoms, and the alkylene group may be straight chain, branched chain or cyclic, D represents —COOM or —$SO_3M$, M represents a hydrogen atom or an alkali metal, and m represents 0 to 1; and wherein the ethylene type unsaturated monomer from group (III) is an ester of acrylic acid other than methyl acrylate, an amide of acrylic acid, an ester of α-chloroacrylic acid, an amide of α-chloroacrylic acid, an ester of α-alkacrylic acid, an amide of α-alkacrylic acid, a vinyl ester or styrene.

2. A silver halide color photographic light-sensitive material as claimed in claim 1, wherein Q is a cyan coupler residue of phenol type represented by the formula (IV) or (V) or of naphthol type represented by the formula (VI);

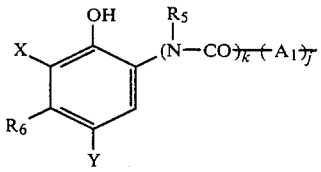

(IV)

-continued (V)

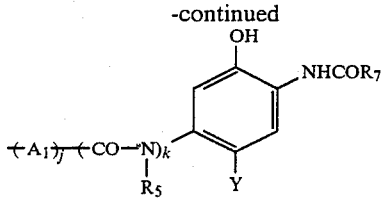

(VI)

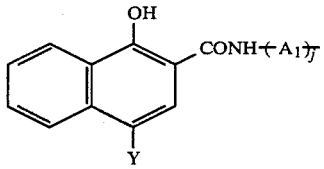

wherein $R_5$ represents a hydrogen atom or a lower alkyl group containing 1 to 4 carbon atom;

$A_1$ represents an unsubstituted or substituted alkylene, aralkylene or phenylene groups containing 1 to 10 carbon atom and which are bonded to the NH group of the general formula (I), and the alkylene group may be a straight chain or branched chain;

$R_6$ represents a hydrogen atom or a lower alkyl group containing 1 to 5 carbon atoms;

$R_7$ represents an unsubstituted or substituted alkyl containing 1 to 22 carbon atoms, phenyl or phenylamino group;

X represents a halogen atom;

Y represents a hydrogen atom, halogen atom or a substituted alkoxy group containing 1 to 22 carbon atoms; and k and j each represent 0 or 1.

3. A silver halide color photographic light-sensitive material as claimed in claim 2, wherein the substituent for the substituted alkylene group, the substituted aralkylene or the substituted phenylene group represented by $A_1$ is an aryl group, a nitro group, a hydroxyl group, a cyano group, a sulfo group, an alkoxy group, an aryloxy group, an acyloxy group, an acylamino group, a sulfonamido group, a sulfamoyl group, a halogen atom, a carboxyl group, a carbamoyl group, an alkoxycarbonyl group or a sulfonyl group.

4. A silver halide color photographic light-sensitive material as claimed in claim 2, wherein the substituent for the substituted alkoxyl group represented by Y is an aryl group, a nitro group, a hydroxyl group, a cyano group, a sulfo group, an alkoxy group, an aryloxy group, an acyloxy group, an acylamino group, an alkylsulfonamido group, an alkylsulfamoyl group, a halogen atom, a carboxyl group, an alkylcarbamoyl group, an alkoxycarbonyl group, an alkylsulfonyl group or an alkylthio group.

5. A silver halide color photographic light-sensitive material as claimed in claim 2, wherein the substituent for the substituted alkyl group or the substituted phenyl group represented by $R_7$ is a fluorine atom.

6. A silver halide color photographic light-sensitive material as claimed in claim 2, wherein the substituent for the substituted phenylamino group represented by $R_7$ is a nitro group, a cyano group, a sulfonamido group, a sulfamoyl group, a halogen atom, a carbamoyl group or a sulfonyl group.

7. A silver halide color photographic light-sensitive material as claimed in claim 1, wherein the ethylene type unsaturated monomer containing the acid component corresponding to the general formula (II) is an acrylic acid, an $\alpha$-chloroacrylic acid, an $\alpha$-alkacrylic acid, or an ester or amide thereof.

8. A silver halide color photographic light-sensitive material as claimed in claim 1, wherein the monomer corresponding to the general formula (III) is an acrylate other than methyl acrylate or a methacrylate.

9. A silver halide color photographic light-sensitive material as claimed in claim 1, wherein the amount of the color forming portion corresponding to the general formula (I) in the oleophilic polymer coupler is 5 to 80% by weight.

10. A silver halide color photographic light-sensitive material as claimed in claim 9, wherein the amount of the color forming portion corresponding to the general formula (I) in the oleophilic polymer coupler is 20 to 70% by weight.

11. A silver halide color photographic light-sensitive material as claimed in claim 1, wherein the amount of the non-color forming portion corresponding to the general formula (II) in the oleophilic polymer coupler is 1 to 30% by weight.

12. A silver halide color photographic light-sensitive material as claimed in claim 11, wherein the amount of the non-color forming portion corresponding to the general formula (II) in the oleophilic polymer coupler is 5 to 20% by weight.

13. A silver halide color photographic light-sensitive material as claimed in claim 1, wherein the amount of the non-color forming portion corresponding to the general formula (III) in the oleophilic polymer coupler is 1 to 80% by weight.

14. A silver halide color photographic light-sensitive material as claimed in claim 13, wherein the amount of the non-color forming portion corresponding to the general formula (III) in the oleophilic polymer coupler is 1 to 60% by weight.

15. A silver halide color photographic light-sensitive material as claimed in claim 1, wherein the gram number of the polymer coupler containing 1 mol of coupler monomer is from 250 to 4,000.

16. A silver halide color photographic light-sensitive material as claimed in claim 1, wherein the amount of the oleophilic polymer coupler is from $2\times10^{-3}$ to $5\times10^{-1}$ mol, calculated as the monomer coupler corresponding to the general formula (I), per mol of silver.

17. A silver halide color photographic light-sensitive material as claimed in claim 16, wherein the amount of the oleophilic polymer coupler is from $1\times10^{-2}$ to $5\times10^{-1}$ mol, calculated as the monomer coupler corresponding to the general formula (I), per mol of silver.

* * * * *